United States Patent [19]

Maurer et al.

[11] 3,969,989

[45] July 20, 1976

[54] IMPACT BUFFER FOR IMPACT DRIVE TOOLS

[75] Inventors: Werner Maurer, Zizishausen; Erich Skuthan, Holzmaden, both of Germany

[73] Assignee: Karl M. Reich Maschinenfabrik GmbH, Nuertingen, Germany

[22] Filed: July 24, 1974

[21] Appl. No.: 491,264

[30] Foreign Application Priority Data

Aug. 2, 1973 Germany ..... 2339163

[52] U.S. Cl. ..... 92/85 R; 92/212; 92/249; 227/130

[51] Int. Cl.[2] ..... F01B 11/02

[58] Field of Search ..... 92/85, 212, 249; 227/130; 267/35, 64 B, 140, 141

[56] References Cited

UNITED STATES PATENTS

| | | | |
|---|---|---|---|
| 2,821,170 | 1/1958 | Jacobus | 227/130 X |
| 2,983,922 | 5/1961 | Juilfs | 92/30 X |
| 3,146,459 | 9/1964 | Bade | 92/212 X |
| 3,205,787 | 9/1965 | Volkmann | 92/85 X |
| 3,231,255 | 1/1966 | Olson | 92/85 X |
| 3,320,860 | 5/1967 | Bade | 92/85 X |
| 3,387,541 | 6/1968 | Bade | 227/130 X |
| 3,403,600 | 10/1968 | Bade | 92/85 X |
| 3,465,650 | 9/1969 | Gluck | 92/85 |
| 3,494,530 | 2/1970 | Bade | 227/130 X |
| 3,512,454 | 5/1970 | Perkins | 227/130 X |

*Primary Examiner*—Martin P. Schwadron
*Assistant Examiner*—Abraham Hershkovitz
*Attorney, Agent, or Firm*—W. G. Fasse; W. W. Roberts

[57] ABSTRACT

An impact drive tool has a cylinder within which a percussive piston is mounted for actuating a ram to drive a nail into a workpiece. Valve means are provided for introducing compressed air to one side of the piston to cause the impact stroke, and an air storage chamber is provided for returning the piston to its rest position. A truncated cone shaped first buffer element of a cellular polyurethane is affixed to the bottom of the percussive piston. A second buffer element of a harder material, such as a cross-linked polyurethane is mounted in the bottom of the cylinder. The second buffer element has a recess facing the first buffer element and shaped to receive the first element. The buffer elements are positioned so that, at the end of an impact stroke, the first buffer element is initially deformed, followed by the striking of a bottom portion of the piston on the second buffer element to absorb the impact energy.

6 Claims, 4 Drawing Figures

IMPACT BUFFER FOR IMPACT DRIVE TOOLS

BACKGROUND OF THE INVENTION

This invention relates to impact drive tools, such as impact drive tools for driving nails or similar articles, and is more particularly directed to improvements in impact buffers for such impact drive tools.

Impact drive tools of the type under consideration herein include a percussive piston mounted to move in a cylinder. Means are provided for directing compressed air to one side of the piston, whereby the piston drives an impact ram, which in turn drives the nail or similar article into a workpiece. An impact buffer is provided to absorb impact energy at the end of an impact stroke.

In the use of impact drive tools of the above type, occasions arise where the impact buffer may be subjected to surplus striking energy, resulting from the use of excess striking pressures or from idle strikes of the percussive piston. Such surplus striking energy may result in the destruction of the impact drive tool, when the percussive piston is braked at the end of its impact stroke. For example, on occasion the nail supply feeding apparatus fails to properly load a nail into the drive tool, whereby the impact drive tool performs an "idle strike" and the entire striking energy of the impact tool must be absorbed by the impact buffer. In addition, in order to insure satisfactory driving of a nail in areas of greater strength of a workpiece, for example, an area containing knots, a surplus of impact energy must be provided. While such surplus energy enables the satisfactory driving of the nails in such areas, the surplus energy is not employed in the driving of the nail in places where the wood is less hard, and consequently the impact buffer must be capable of absorbing this surplus energy.

In the past, impact buffers provided in impact drive tools have been incapable of completely absorbing the striking energy in the event of idle strikes, since such impact buffers are designed to be completely compressed with a low striking energy of the percussive piston. The residue of the striking energy is thus transmitted to the casing of the drive tool. Considerable increases in pressure consequently occur which may result in fractures at the edges of the impact buffers, as well as in their complete destruction.

In the past it has been preferred to employ a polyurethane material, marketed under the trade name "VULKOLLAN" for the impact buffers. In order to absorb the striking energy without immediate damage to the buffer body, a VULKOLLAN quality with a hardness of at least 42 Shore D according to DIN 53 505 with a modulus of elasticity of at least 900 kgf/cm$^2$ had to be used. Since drive tools of the above type are frequently portable tools having limited dimensions, a brake path of only approximately 4 to 5 millimeters was available to brake the percussive piston in known impact buffers. The high retarding forces resulted in rapid wear of the buffer body. Further, the occurrence of mass forces resulted in the reduction of life of the various individual components of the impact drive tool, such as the impact ram, casing, cylinder foot and magazine.

OBJECTS OF THE INVENTION

In view of the foregoing, it is the aim of the invention to achieve the following objects singly or in combination:

to provide an impact buffer for an impact drive tool which is capable of satisfactorily absorbing surplus striking energy, thereby overcoming the above disadvantages of known impact buffers; and to provide an impact buffer for impact drive tools which may have the smallest possible dimensions, is capable of effectively absorbing high striking energies and dissipating them, thereby ensuring the longest possible life of the impact buffer and reducing the wear of the components of the impact drive tool.

SUMMARY OF THE INVENTION

In accordance with the invention, the above objectives are achieved by providing an impact buffer employing two buffer elements, one of which is made of a volume-compressible material having a cellular structure.

In a preferred embodiment of the invention, a buffer element of a cellular polyurethane elastomer is connected to the percussive piston, and a second buffer element of a cross-linked polyurethane is affixed to the bottom of the cylinder of the impact drive tool. The impact buffer of polyurethane elastomer projects below the piston, so that in the initial stage of energy absorption, the polyurethane buffer element is deformed and the air driven out of its cellular structure. In the second stage of the absorption of impact energy, an area on the bottom of the piston strikes the cross-linked polyurethane buffer, to complete the absorption of the impact energy.

This combination of buffer elements provides a progressive spring characteristic, and enables the safe absorption of the striking energy. Braking of the percussive piston can thereby be obtained with such retarding forces as to provide a considerably longer life than was possible with known impact buffers. The arrangement further inhibits the damage or destruction of the components of the impact drive tool.

BRIEF FIGURE DESCRIPTION:

In order that the invention may be more clearly understood, it will now be described in greater detail with reference to the accompanying drawings, wherein.

DETAILED DESCRIPTION OF EXAMPLE EMBODIMENTS

Figure 1:
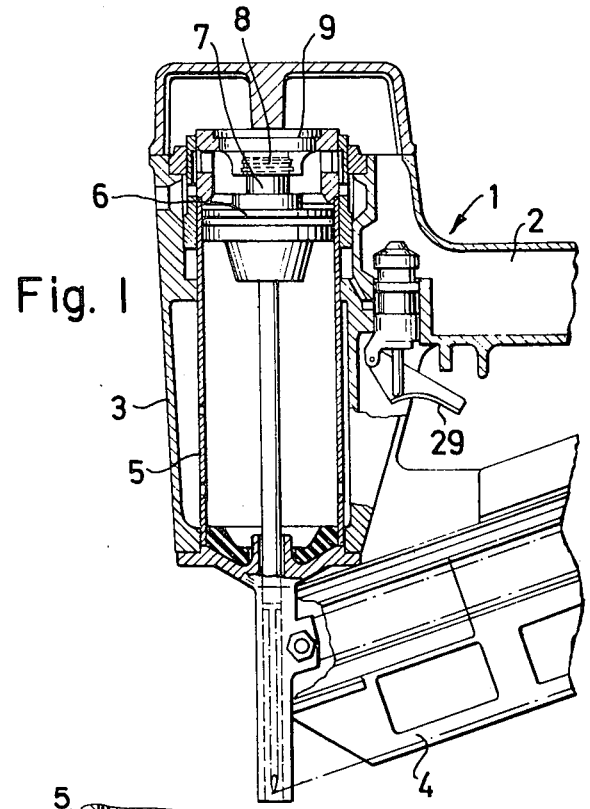
FIG. 1 is a partial, axial sectional side view of an impact drive tool incorporating an impact buffer in accordance with the invention.
Figure 2:
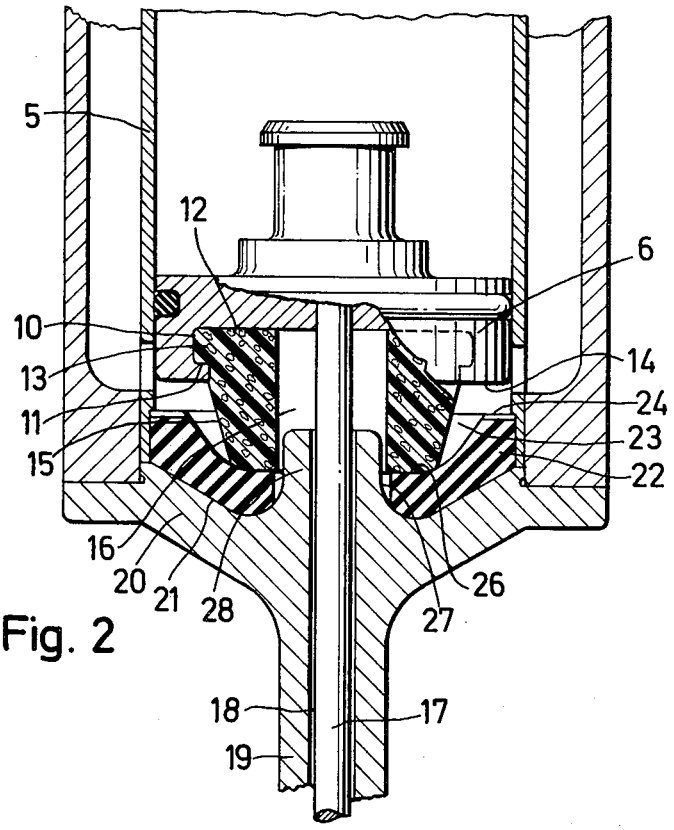
FIG. 2 is an enlarged partial, axial sectional view of a portion of the impact drive tool of FIG. 1, illustrating the impact buffer in greater detail immediately prior to the damping action.

Referring now to FIG. 1, an impact drive tool 1 incorporating an impact buffer in accordance with the invention is comprised of a casing 3 having a hollow handle 2 adapted to be connected by conventional means (not shown) to a source of pressure, e.g. an air compresser to actuate the tool. The casing 3 has an open top, which is covered by a suitable cover to direct air from the handle 2 to the top of the casing. A cylinder foot 19, as best seen in FIG. 2, is secured by suitable means to cover the open bottom of the casing, and a magazine 4 for feeding nails or other articles to be driven is mounted to feed the nails or similar articles to the guide duct 18 of the cylinder foot, as illustrated in FIG. 1.

A cylinder 5 is fixedly mounted in the casing. A percussive piston 6 is mounted for movement in the cylinder and an impact ram 17 affixed to the bottom of the percussive piston 6 extends downwardly into the guide channel 18, for driving nails or similar articles therethrough during an impact stroke of the tool. The percussive piston 6 is adapted to move between a rest position, as illustrated in FIG. 1, and a braking position at the bottom of the cylinder (FIG. 2). In the rest position, a head 7 on the percussive piston is positively engaged in a recess 8 of a retaining sleeve 9, the retaining sleeve 9 being affixed at the upper end of the cylinder in the cylinder compartment. This arrangement enables the piston to be releasably held in its rest position prior to an impact stroke. A suitable arrangement for holding the piston in its rest position is disclosed in U.S. Pat. Application Ser. No. 491,265 filed July 24, 1974 corresponding to German Patent Application P 23 39 162 filed Aug. 2, 1973.

The lower portion of the casing 3 is shaped to provide an air storage chamber, connected by suitable ducts through the cylinder 5 to the interior of the cylinder. When the piston 6 is moved downwardly during an impact stroke, air is driven into the air storage cavity, by way of the ducts, to compress the air in the cavity. This compressed air provides a force for returning the percussive piston 6 to its rest position following an impact stroke.

The casing 3 is shaped to form an annular cylinder surrounding the upper end of the cylinder 5 and a valve ring is slidably mounted in this annular cylinder. The bottom of the annular cylinder is connected by a duct through the operating valve 29 with the hollow handle, so that upon actuation of the valve 29, the annular cylinder is vented through this duct and through valve 29 into the atmosphere.

The valve ring has ports through its side walls directed, in the position illustrated in FIG. 1, to an exhaust port in the casing, by way of an annular groove surrounding the annular cylinder.

The valve ring further has an internal angular groove adjacent the ports, and ports in a retaining member at the upper end of the cylinder 5, for holding the retaining sleeve 9, provide a path for exhausting compressed air from above the piston 6 by way of the internal grooves and ports in the valve ring, the annular groove in the casing 3 and the exhaust port in the casing 3.

Upon the releasing of air out of the bottom of the annular cylinder below the valve ring by way of the duct and valve 29, the valve ring is moved into its lowermost control position, as a result of the application of compressed air from the hollow handle to the upper edge surface of the valve ring, wherein compressed air flowing through the hollow handle 2 and the top cover of the casing may pass axially through the ports in the holding member for the retaining sleeve 9, into the space above the piston 6, to initiate an impact stroke of the impact tool.

Upon release of the valve 29, compessed air is directed to the bottom of the annular cylinder by the valve 29 so that the valve ring is forced to its upper position.

The side of the percussive piston 6 opposite the head 7 has a concentric recess 10 with a radially inwardly extending collar 11 at the lower end of the recess 10, as illustrated in FIG. 2. A first buffer element 12 of cellular polyurethane is mounted in the recess 10 with a flange 13 at the upper end of the buffer element 12 having a diameter equal to the diameter of the recess 10. Said collar 11 at the bottom of the recess extends inwardly to firmly hold the buffer element 12 in position at the bottom side of the percussive piston. The bottom side of the percussive piston 6, below the recess 10, is formed as an annular surface 14, in a plane normal to the axis of the cylinder 5. The buffer element 12 projects downwardly toward the cylinder foot 19 beyond the surface 14 of the percussive piston and is formed in the shape of a frustrum of a cone 15 having a cylindrical bore 16 passing through its entire axial length. The major diameter of the frustrum of a cone 15 is at the end thereof toward the percussive piston 6.

Figure 3:
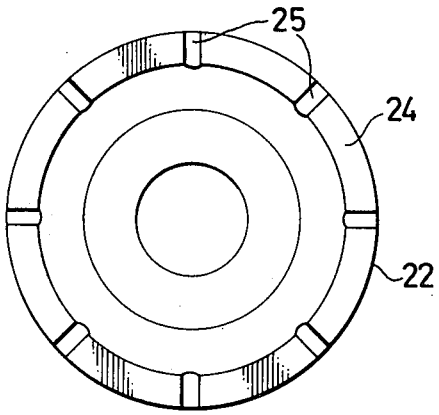
FIG. 3 is a top view of the second buffer element of the impact buffer employed in the impact drive tool of FIGS. 1 and 2.

The cylinder bottom 20 of the cylinder foot 19 adjacent the braking position of the percussive piston 6 has a conical support area 21 facing the interior of the cylinder 5, the upper end of the support area 21 toward the cylinder 5 having the greater diameter. A second buffer element 22 of VULKOLLAN rests on the conical support area 21. This second buffer element has a cavity 23 in the form of a frustrum of a cone, the cavity being open toward the percussive piston 6. The second buffer element further has an annular surface, in a plane normal to the axis of the cylinder 5, extending from the upper end of the cavity 23 to the radially outer perimeter of the buffer element 22. As is illustrated more clearly in FIG. 3, radially directed grooves 25 are provided in the surfaces 24. The cavity 23 has a flat bottom 26, as illustrated in FIG. 2, extending radially inwardly from the bottom of the truncated cone shaped surface of the cavity 23, in a plane normal to the axis of the cyliner 5. The cavity 23 thereby is in the shape of a frustrum of a cone. A concentric bore 27 extends completely through the bottom wall of the second buffer element 22.

A guide lug 28 extends upwardly from the center of the conical cylinder bottom 20 of the cylinder foot 19, the outer diameter of the lug 28 being smaller than the diameters of the bores in the first buffer element 12 and second buffer element 27.

Figure 4:
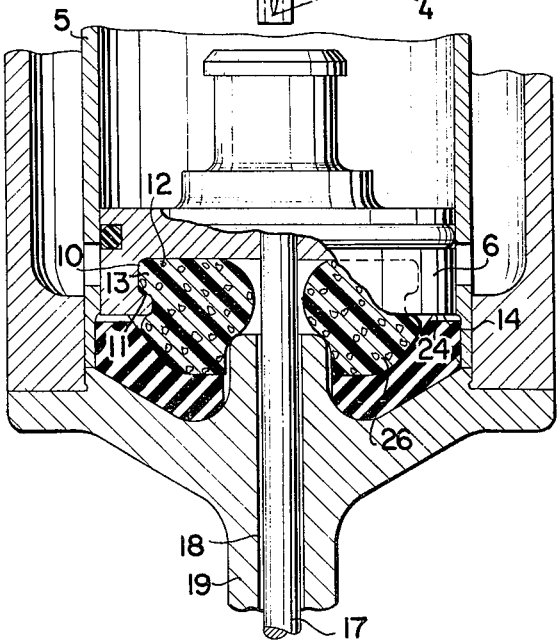
FIG. 4 is a view similar to that of FIG. 2, but showing the lowermost piston position.

When the operating lever 29 on the handle 2 is actuated, compressed air is vented through the duct from the bottom of the annular cylinder below the ring valve, as above discussed, to enable compressed air from the handle 2 to enter the space between the percussive piston 6 and the retaining sleeve 9. When the pressure rises sufficiently, the positive connection between the head 7 of the percussive piston 6 and the retaining sleeve 9 is overcome, and the compressed air acting on the percussive piston 6 in the impact stroke, thereby moves the percussive piston from its rest position, as illustrated in FIG. 1, to its braking position, as illustrated in FIG. 2. When the first buffer element 12 strikes the bottom 26 of the second buffer element 22 at the end of the impact stroke, the first buffer element 12 is initially compressed and deformed. The air contained in the cells of the first buffer element 12 escapes and due to its high elasticity the buffer element 12 fills substantially the available space of the cavity 23 below the piston 6 as shown in FIG. 4. A portion of the striking energy is thus absorbed. This first deformation stage requires a resilience path of approximately 5 millimeters. After the annular area 14 of the percussive piston 6 strikes the annular area 24 of the second buffer element 22, the second deformation stage begins. This second stage requires a resilience path of approximately 4 millimeters. During the second deformation stage the first buffer element 12 is further compressed and due to the greater hardness of the second buffer element 22, the striking energy is almost completely absorbed.

The air compressed between the percussive piston 6 and the second buffer element 22 can escape through the radial grooves 25 in the second buffer element. The guide lug 28 prevents the deforming first buffer elements 12 from being deformed into contact with the impact ram 17 and hence obstructing the return stroke of the percussive piston 6.

Prior to the release of the percussive piston in an impact stroke, a nail or a similar article stored in the magazine 4 is fed to the guide channel 18 in a known manner. During the impact stroke of the percussive piston as described above, the free lower end of the impact ram 17 which is adapted to slide in the guide channel 18, strikes the head of a nail positioned in the guide channel 18, and hence effects the driving of a nail into a workpiece.

The impact buffer as above described thus provides a progressive spring characteristic, due to the cell-like structure of the first buffer element 12, the cells of this buffer element being to a large extent open and porous. In addition, air is pressed out of the cells when the buffer element is deformed at the end of an impact stroke, the air being drawn into the buffer element 12 when the buffer element returns to its normal shape during the return stroke. This movement of air into and out of the buffer element 12 serves to remove damping heat from the buffer element.

This effect is important in an impact drive tool of the above described type, which may be operated with striking rates of a maximum of about 300 impact strokes per minute.

The arrangement in accordance with the invention enables the safe absorption of the striking energy and braking of the percussive piston with such retarding forces as to provide a considerably longer life than was possible in previously employed impact buffers. Further, the impact buffer in accordance with the invention inhibits damage or destruction to the components of the tool, such as the impact rams, casings, cylinder foot and magazines, due to the great forces applied to the tool in the impact stroke.

The first buffer element 12 is preferably formed of a cellular polyurethane elastomer and the second buffer element 22 preferably is made of a cross-linked polyurethane.

The buffer element in accordance with the present invention thus enables the absorption of the entire striking energy, so that damage to the impact tool is inhibited, even in the event of idle strikes, and even through the impact energy is sufficient to drive the nail or similar article into areas of great hardness of the workpiece.

Although the invention has been described with reference to specific example embodiments, it is to be understood, that it is intended to cover all modifications and equivalents within the scope of the appended claims.

What is claimed is:

1. In an impact drive tool for driving nails or similar articles having a percussive piston mounted for movement in a cylinder, means for directing a pressure medium into one end of the cylinder to initiate an impact stroke driving the piston toward the other end of the cylinder, and impact buffer means positioned to absorb driving energy at the end of the impact stroke, wherein said buffer means comprise a first buffer element secured to said piston to face the other end of the cylinder, and a second buffer element secured to the other end of the cylinder, the improvement wherein said first buffer element comprises a material having an open cell structure in which the open cells are distributed substantially uniformly whereby the volume of said first buffer element is compressible, wherein said second buffer element comprises an elastic material which is harder than the material of the first buffer element, wherein said percussive piston has a surface facing toward said other end of said cylinder, said first buffer element having a portion projecting toward said other end of said cylinder past said piston surface, said second buffer element having a cavity open toward said percussive piston and a ring surface surrounding said cavity and positioned to be struck by said surface of said piston, said ring surface of said second buffer element having radially extending grooves, said cavity in the second buffer element being positioned so that the first buffer element is compressed in said cavity prior to the piston reaching its work stroke end position in which the piston impacts on said annular surface of the second buffer element, the first buffer element substantially filling the available space of said cavity in said second buffer element when the piston has reached the end of said impact stroke, said radially extending grooves allowing escape of the air expelled from said open cell structure of the first buffer element.

2. The impact drive tool of claim 1, wherein said first buffer element is made of an open cell polyurethane elastomer, and said second buffer element is made of a cross-linked polyurethane.

3. The impact drive tool of claim 1, wherein said projecting portion of said first buffer element is frustoconical, and said recess in said second buffer element is substantially frustoconical.

4. The impact drive tool of claim 1, wherein said side of said piston surface has a recess with a radially inwardly directed collar, said first buffer element extending into said recess and being held therein by said collar.

5. The impact drive tool of claim 1, wherein said first buffer element is concentrically mounted in said piston surface facing toward said other end of said cylinder, said piston surface having an annular shape and extending radially outwardly of said first buffer element, said second buffer element being fixedly mounted at the other end of said cylinder in such a position that its cavity is axially aligned with said projecting portion of said first buffer element, and so that the annular piston surface is substantially aligned wth said ring surface of said second buffer element, whereby following an impact stroke, said first buffer element first strikes said second buffer element in said cavity to effect an initial compression of said first buffer element, and whereby following said initial compression said annular surface of said piston strikes said ring surface of said second buffer element whereupon said first buffer element is further compressed.

6. The impact drive tool of claim 5, wherein said first buffer element is of an open cell polyurethane elastomer, and said second buffer element is of a cross-linked polyurethane.

* * * * *